US006221173B1

(12) United States Patent
Shibuya et al.

(10) Patent No.: US 6,221,173 B1
(45) Date of Patent: Apr. 24, 2001

(54) TITANIUM OR TITANIUM ALLOY MEMBER AND SURFACE TREATMENT METHOD THEREFOR

(75) Inventors: Yoshitsugu Shibuya, Omiya; Masahiro Sato, Iruma; Junji Sato, Kawagoe; Takanori Nanya, Sayama; Kenji Hanai, Musashimurayama, all of (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/155,499

(22) PCT Filed: Mar. 25, 1997

(86) PCT No.: PCT/JP97/00992

§ 371 Date: Sep. 24, 1998

§ 102(e) Date: Sep. 24, 1998

(87) PCT Pub. No.: WO97/36018

PCT Pub. Date: Oct. 2, 1997

(30) Foreign Application Priority Data

Mar. 26, 1996 (JP) ..... 8-070180
Dec. 27, 1996 (JP) ..... 8-349365
Jan. 14, 1997 (JP) ..... 9-004482

(51) Int. Cl.[7] ..... C22C 14/00; C22F 1/02; C21D 1/06

(52) U.S. Cl. ..... 148/223; 148/238; 148/421; 148/671; 148/317

(58) Field of Search ..... 148/223, 238, 148/671, 317

(56) References Cited

FOREIGN PATENT DOCUMENTS 58-37383 8/1983 (JP) .
59-10429 3/1984 (JP) .
61-69956 4/1986 (JP) .
62-21865 5/1987 (JP) .
6-41715 2/1994 (JP) .
7-310513 11/1995 (JP) .

OTHER PUBLICATIONS

English Abstract of Japan patent 356119763A Sep. 19, 1981.*

* cited by examiner

*Primary Examiner*—Deborah Yee
(74) *Attorney, Agent, or Firm*—Armstrong, Westerman, Hattori, McLeland & Naughton L.L.P.

(57) ABSTRACT

Disposing the titanium or titanium alloy in a vacuum vessel, and applying annealing treatment thereto by heating (a heating process); feeding a mixed gas consisting primarily of nitrogen with a trace of oxygen component into the vessel, and heating inside the vacuum vessel at temperatures in the range of 700 to 800° C. in a predetermined reduced pressure condition for a predetermined length of time such that nitrogen and oxygen are diffused into the interior of the titanium or titanium alloy from the surface thereof so as to pass into solid solution therein (a hardening treatment process); and cooling the titanium or titanium alloy to room temperature after the hardening treatment process (a cooling process), are carried out. After completion of the processes described above, a hard surface layer 101 is formed in the surface region of the titanium or titanium alloy 100. The hard surface layer 101 comprises a first hard layer 102 where nitrogen atoms 104 and oxygen atoms 105 reside in solid solution, and a second hard layer 103 where oxygen atoms 105 reside in solid solution.

14 Claims, 5 Drawing Sheets

TITANIUM OR TITANIUM ALLOY MEMBER AND SURFACE TREATMENT METHOD THEREFOR

TECHNICAL FIELD

The present invention relates to a titanium or titanium alloy for use in decorative articles such as a wristwatch case, wristwatch band, pierced earrings, earrings, a ring, the frame of eyeglasses, and a method of surface treatment thereof.

BACKGROUND TECHNOLOGY

A titanium or titanium alloy has recently attracted much attention as a metallic member hardly causing metallic allergy and friendly to human bodies, and consequently, has been utilized for such decorative articles as represented by a wristwatch, eyeglasses, accessories, and the like.

It has been pointed out, however, that the titanium or titanium alloy has a problem of susceptibility to scratches due to its low surface hardness, and a tendency of degradation in the quality of appearance after use for long duration.

Many attempts have so far been made to apply various surface hardening treatments to the titanium or titanium alloy in order to overcome such problems.

Conventional methods of applying a surface hardening treatment to the titanium or titanium alloy can be broken down into a method of coating the surface of a metal with a hard film, and a method of hardening the metal itself.

Among methods of coating the surface of the metal with the hard film, there are known a wet process as represented by electroplating, and a dry process as represented by vacuum deposition, ion plating, sputtering, plasma CVD, and the like.

Any of these methods, however, has had a problem with adhesion between the titanium or titanium alloy and the hard film, and a drawback of the hard film being prone to peeling off.

On the other hand, ion implantation, ion nitriding, gas nitriding, carburizing, and the like are well known among methods of applying a hardening treatment to the titanium or titanium alloy itself. There is no risk of a hard layer, formed at the surface of the titanium or titanium alloy by means of such surface hardening methods, peeling, as in the case of the hard film described above.

However, conventional surface hardening methods have had shortcomings of low productivity due to long processing time, and also a drawback of degradation in the quality of appearance because the surface of the titanium or titanium alloy becomes coarse due to growth of crystal grains taking place in the surface owing to high processing temperatures. It has further been pointed out that since it is difficult to form a hard layer in regions deep down from the surface, there is a tendency for the quality of appearance to deteriorate due to scratches and the like incurred during use, presenting a major problem.

The invention has been developed in light of the circumstances described above. That is, it is an object of the invention to provide a titanium or titanium alloy superior in the quality of appearance, and having hardness sufficient to withstand large impact.

Another object of the invention is to provide a surface treatment method whereby a titanium or titanium alloy is provided with such properties as described in the foregoing.

DISCLOSURE OF THE INVENTION

To this end, a titanium or titanium alloy according to the invention is of a structure wherein a hard surface layer is formed up to an optional depth from the surface, and the hard surface layer comprises a first hard layer, formed in a region up to an optional depth from the surface and containing nitrogen and oxygen in solid solution therein, and a second hard layer, formed in a region at an optional depth deeper than the first hard layer and containing oxygen in solid solution therein.

That is, in order not to cause the surface roughness but yet to enhance surface hardness thereof, there is a need of forming the first hard layer in the vicinity of the surface of the titanium or titanium alloy, containing nitrogen as well as oxygen in solid solution therein.

Further, in order to obtain the hard surface layer extended up to greater depths, there is a need of forming the second hard layer containing oxygen in solid solution at depths of the member, deeper than the first hard layer.

It has been made possible to obtain the titanium or titanium alloy having not only excellent quality of appearance without the surface roughness thereof but also sufficient hardness by forming the hard surface layer comprising the first hard layer with nitrogen and oxygen residing in solid solution therein, and the second hard layer with oxygen residing in solid solution therein.

In this connection, in the first hard layer, nitrogen and oxygen in solid solution can be contained in the range of 0.6 to 8.0 wt % for nitrogen, and in the range of 1.0 to 14.0 wt % for oxygen. In the second hard layer, oxygen in solid solution can be contained in the range of 0.5 to 14.0 wt %. Accordingly, it is desirable to contain as much nitrogen or oxygen in solid solution as possible within the aforesaid ranges wherein these elements can reside in solid solution.

However, from the standpoint of maintaining excellent quality of appearance, there is need for selecting the concentration of nitrogen or oxygen in solid solution within ranges so as not to cause the surface roughness.

Further, the first hard layer with nitrogen and oxygen in solid solution residing therein may preferably be formed substantially up to a depth of 1.0 $\mu$m from the surface. By forming the first hard layer at such a depth, formation of the coarse surface due to growth of crystal grains can be inhibited while sufficient surface hardness can be obtained.

On the other hand, the second hard layer with oxygen in solid solution residing therein may preferably be formed in a region deeper than the first hard layer and substantially up to 20 $\mu$m from the surface. By forming the second hard layer at such a depth, surface hardness can be further enhanced.

In this description of the invention, the titanium is a metal composed primarily of high purity titanium, and refers to titanium class 1, class 2, class 3, and the like as described in the JIS (Japan Industrial Standards). The titanium alloy is a metal composed primarily of a high purity titanium with aluminum, vanadium, iron, and the like added thereto, and refers to titanium 60, 60E, and the like as described in the JIS. Besides the elements described, various titanium alloys and intermetallic compounds of various titanium radicals may be included in the titanium alloy.

The titanium or titanium alloy according to the invention has major applications for decorative articles such as a wristwatch case, wristwatch band, pierced earrings, earrings, a ring, the frame of eyeglasses, and the like. It is important for these decorative articles to have high quality in appearance and maintain a property impervious to scratches for a long duration. The titanium or titanium alloy according to the invention can meet such requirements.

A first method (first method of the invention) of surface treating a titanium or titanium alloy, according to the invention, comprises the following processes:

(1) a heating process comprising steps of disposing a titanium or titanium alloy in a vacuum vessel, and applying annealing treatment thereto by heating;

(2) a hardening treatment process comprising steps of feeding a mixed gas consisting primarily of nitrogen with a trace of oxygen component into the vacuum vessel, and heating inside the vacuum vessel at temperatures in the range of 700 to 800° C. in a predetermined reduced pressure condition for a predetermined length of time such that nitrogen and oxygen are diffused into the interior of the titanium or titanium alloy from the surface thereof so as to pass into solid solution therein; and (3) a cooling process whereby the titanium or titanium alloy is cooled to room temperature after the hardening treatment process.

For example, at the surface of the titanium or titanium alloy formed into a desired shape by hot forging and polishing thereafter, there exists a working strain layer. Accordingly, in the method of surface treatment of the titanium or titanium alloy according to the invention, a heating process whereby an annealing treatment is applied thereto by heating in order to moderate the working strain layer.

The working strain layer caused by polishing represents stress applied during abrasive machining that remains in the form of lattice distortion, and is in the state of an amorphous phase or degraded crystallinity.

In the case of applying the succeeding hardening treatment process to the titanium or titanium alloy after polishing by omitting the heating process for applying annealing treatment thereto, diffusion of nitrogen and oxygen and passing into solid solution proceed in the hardening treatment process while moderating the working strain layer.

As a result, amounts of nitrogen and oxygen reacting at the surface of the titanium or titanium alloy are increased, resulting in formation of nitrides and oxides, which are colored substances, in the vicinity of the surface, while amounts of nitrogen and oxygen being diffused into the interior of the titanium or titanium alloy, and passing into solid solution, are decreased. Formation of such colored substances is undesirable because of degradation in the quality of appearance.

Therefore, in the method according to the invention, the heating process is applied prior to the hardening treatment process so that the working strain layer is eliminated beforehand, promoting nitrogen and oxygen to pass into solid solution during the hardening treatment process.

It is desirable to apply the heating process under reduced pressure conditions where the vacuum vessel is evacuated to a degree of vacuum, or where an inert gas is, fed into the vacuum vessel after the vacuum vessel is evacuated to a degree of vacuum. By applying the heating process in such an atmosphere, the titanium or titanium alloy is prevented from reacting with impurities other than nitrogen and oxygen components (to be introduced during the hardening treatment process).

Subsequently, in the hardening treatment process, a mixed gas primarily consisting of nitrogen, containing a trace of oxygen, is fed into the vacuum vessel, causing nitrogen and oxygen to be diffused into the interior of the titanium or titanium alloy from the surface thereof, and to reside in solid solution therein.

By means of the hardening treatment process, a first hard layer wherein nitrogen and oxygen reside in solid solution is formed in a region close to the surface of the titanium or titanium alloy while a second hard layer wherein oxygen reside in solid solution at depth of the titanium or titanium alloy is formed below the first hard layer.

As a source of the trace of oxygen component contained in the mixed gas, various gasses containing oxygen can be utilized. For example, oxygen gas, hydrogen gas, water vapor, ethyl alcohol, methyl alcohol, and the like are cited among the sources of the oxygen component. Further, carbon dioxide gas or carbon monoxide gas may be contained in water vapor.

The hardening treatment process requires that nitrogen and a trace of oxygen be diffused into the interior of the titanium or titanium alloy and reside in solid solution therein without forming compounds. For this reason, the treatment temperature in the hardening treatment process is of great importance.

In order to find out the optimum treatment temperature, the inventor carried out the method of surface treating according to the invention, using a mirror polished testpiece, prepared from titanium material, class 2, as defined by JIS as a testpiece, and by varying treatment temperatures variously in the range of 630 to 830° C.

For the mixed gas consisting primarily of nitrogen, containing a trace of oxygen, a mixed gas containing 99.4% nitrogen with 2000 ppm (0.2%) of oxygen and 4000 ppm (0.4%) of hydrogen, added thereto, was used. The inside of the vacuum vessel was rendered to be in reduced pressure conditions, and heat treatment was applied for the duration of 5 hours.

Measurement of Vickers hardness was made of the testpiece after the hardening treatment process was applied thereto. FIG. 1 shows the results.

As is evident from the figure, when the treatment temperature was lower than 700° C., Vickers hardness was found to be Hv=750 or lower, indicating that satisfactory hardening treatment was not provided. This is attributable to the fact that sufficient diffusion of nitrogen and oxygen into the testpiece and passing into solid solution thereof do not occur at a treatment temperature lower than 700° C., and consequently, the first and second hard layers could not be properly formed.

On the other hand, when the treatment temperature was higher than 800° C., Vickers hardness was found at Hv=1100 or higher because of high velocities at which nitrogen and oxygen are diffused into the testpiece, and pass into solid solution, enabling formation of the hard layers at greater depths of the testpiece.

It has been found, however, that when the treatment temperature exceeds 800° C., the surface becomes coarse because of growth of crystal grains. Accordingly, high quality of appearance can not be obtained when the treatment temperature is set at a temperature in excess of 800° C.

In the method of surface hardening a titanium previously proposed by one of the inventors (Japanese Patent Laid-open No. S61-69956), the treatment temperature was set in the range of 800 to 880° C. In this case, the surface became coarse as described above, and consequently, there was need of inserting a step of polishing the surface, and the like in a post-treatment process.

On the basis of test results described above, in the method according to the invention, it has been decided that the hardening treatment process is to be applied at a temperature within a range of 700 to 800° C.

The concentration of oxygen contained in the mixed gas consisting primarily of nitrogen as described in the foregoing is optional. However, it may preferably be adjusted to be in the range of 100 to 30000 ppm with respect to nitrogen. That is, if the concentration of oxygen is lower than 100 ppm (0.01%), satisfactory passing of oxygen into solid solution does not take place while if the concentration of oxygen exceeds 30000 ppm (3%), an oxide layer is formed on the surface of the titanium or titanium alloy, raising a risk of rendering the surface roughness.

Further, in the first method according to the invention, the hardening treatment process is applied in reduced pressure conditions. The extent to which pressure is reduced is optional. However, the internal pressure inside the vacuum vessel may preferably be adjusted to be within the range of 0.01 to 10 Torr.

The cooling process is applied to rapidly cool the titanium or titanium alloy, after the hardening treatment process is applied, to room temperature.

It is desirable not to perform the cooling process in the same atmosphere as in the hardening treatment process. In the case that the cooling process is performed in the same atmosphere as in the hardening treatment process, nitrides and oxides are formed on the surface of the titanium or titanium alloy, raising a risk of impairing quality of appearance.

Accordingly, the cooling process may preferably be performed in an atmosphere of an inert gas such as argon, helium, or the like. More specifically, in the cooling process, after removing the mixed gas consisting primarily of nitrogen, containing a trace of oxygen, by evacuating the vacuum vessel to a high degree of vacuum, and then introducing the inert gas into the vacuum vessel, the titanium or titanium alloy may preferably be cooled to room temperature in reduced pressure conditions. The cooling process may be applied in a vacuum atmosphere.

Now, a second method (second method of the invention) of surface treating a titanium or titanium alloy, according to the invention, comprises the following processes:

(1) a heating process comprising the steps of disposing a titanium or titanium alloy in a vacuum vessel, and applying an annealing treatment thereto by heating;

(2) a hardening treatment process comprising the steps of removing an inert gas by evacuating the vacuum vessel to a high degree of vacuum, adjusting pressure inside the vacuum vessel to correspond to atmospheric pressure by feeding a mixed gas consisting primarily of nitrogen with a trace of oxygen into the vacuum vessel, and heating inside the vacuum vessel at temperatures in the range of 700 to 800° C. for a predetermined length of time such that nitrogen and oxygen are diffused into the interior of the titanium or titanium alloy from the surface thereof so as to pass into solid solution therein; and (3) a cooling process whereby the titanium or titanium alloy is cooled to room temperature after the hardening treatment process.

The second method of the invention differs from the first method of the invention in that the heating process and hardening treatment process are applied under atmospheric pressure in the case of the former.

When the heating process is applied under atmospheric pressure, an inert gas is fed into the vacuum vessel in order to prevent the titanium or titanium alloy, which is an active metal, from reacting with impurities other than nitrogen and oxygen components.

Objects and basic operation of respective processes of the second method of the invention are similar to those for the first method of the invention.

In the second method of the invention as well, the heating process may preferably be applied in reduced pressure conditions after the vacuum vessel is evacuated to a degree of vacuum, or it is desirable to perform the heating process in an atmosphere adjusted to be at atmospheric pressure by feeding an inert gas into the vacuum vessel after evacuating the vacuum vessel. The heating process performed under such an atmosphere is able to prevent the titanium or titanium alloy from reacting with nitrogen and oxygen components (to be introduced in the hardening treatment process).

As a supply source of the oxygen contained in the mixed gas for use in the hardening treatment process, various gasses containing oxygen can be utilized. For example, oxygen gas, hydrogen gas, water vapor, alcoholic gas such as ethyl alcohol, methyl alcohol, and the like are cited among the sources of the oxygen component. Further, carbon dioxide gas or carbon monoxide gas may be contained in water vapor.

As in the case of the first method of the invention, it is desirable not to perform the cooling process in the same gas atmosphere as that in the hardening treatment process. More specifically, it is desirable to apply the cooling process for cooling to room temperature after removing the mixed gas containing the trace of oxygen by evacuating the vacuum vessel to a high degree of vacuum, and subsequently adjusting pressure inside the vacuum vessel to correspond to atmospheric pressure by feeding an inert gas therein. The cooling process may be performed in a vacuum atmosphere.

BEST MODE FOR CARRYING OUT THE INVENTION

The best mode for carrying out the invention is described hereinafter referring to embodiments carried out by the inventor.

Figure 1:
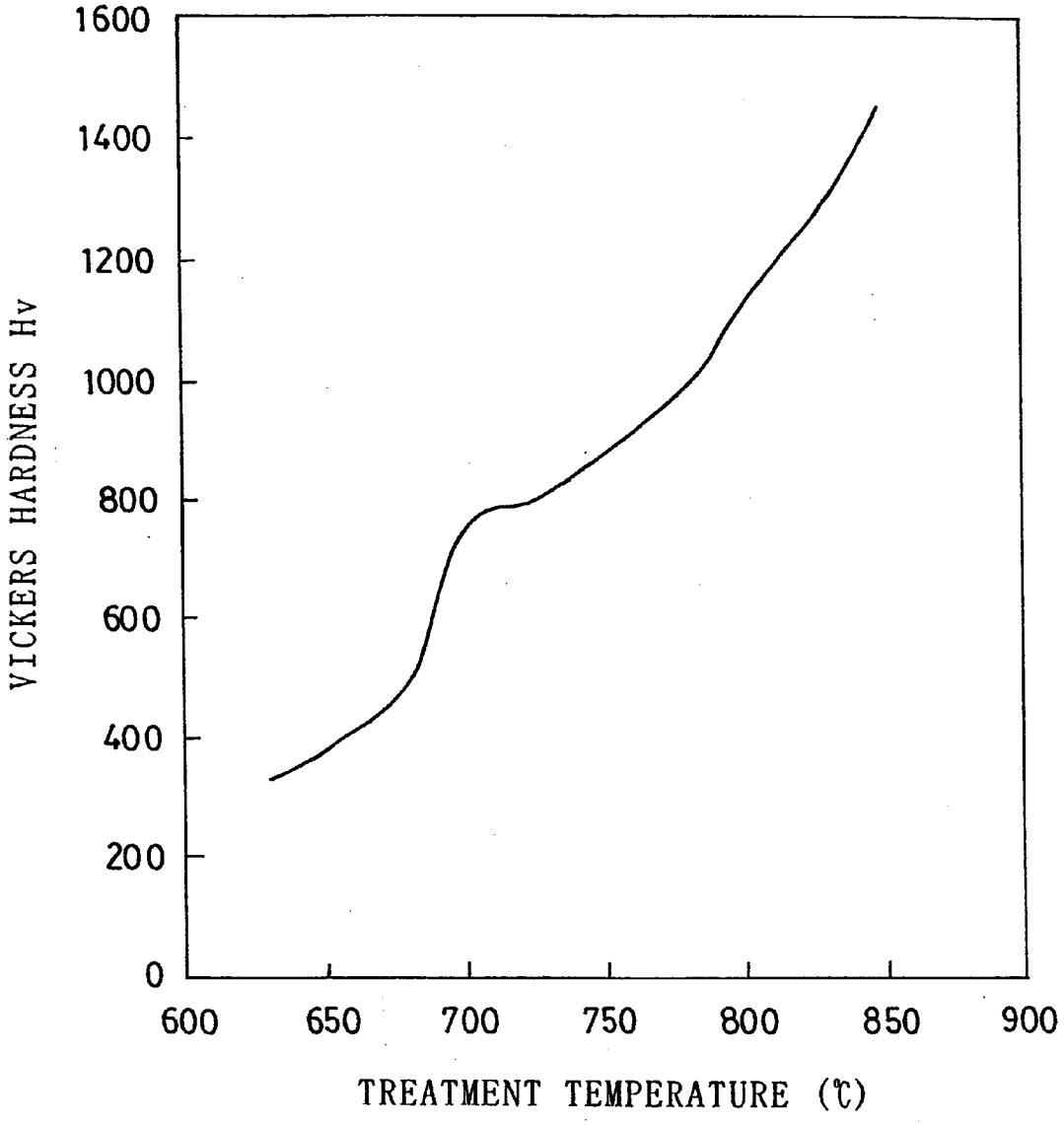
FIG. 1 is a graph showing the results of measuring Vickers hardness of a testpiece surface hardened by the method of the invention.
Figure 2:
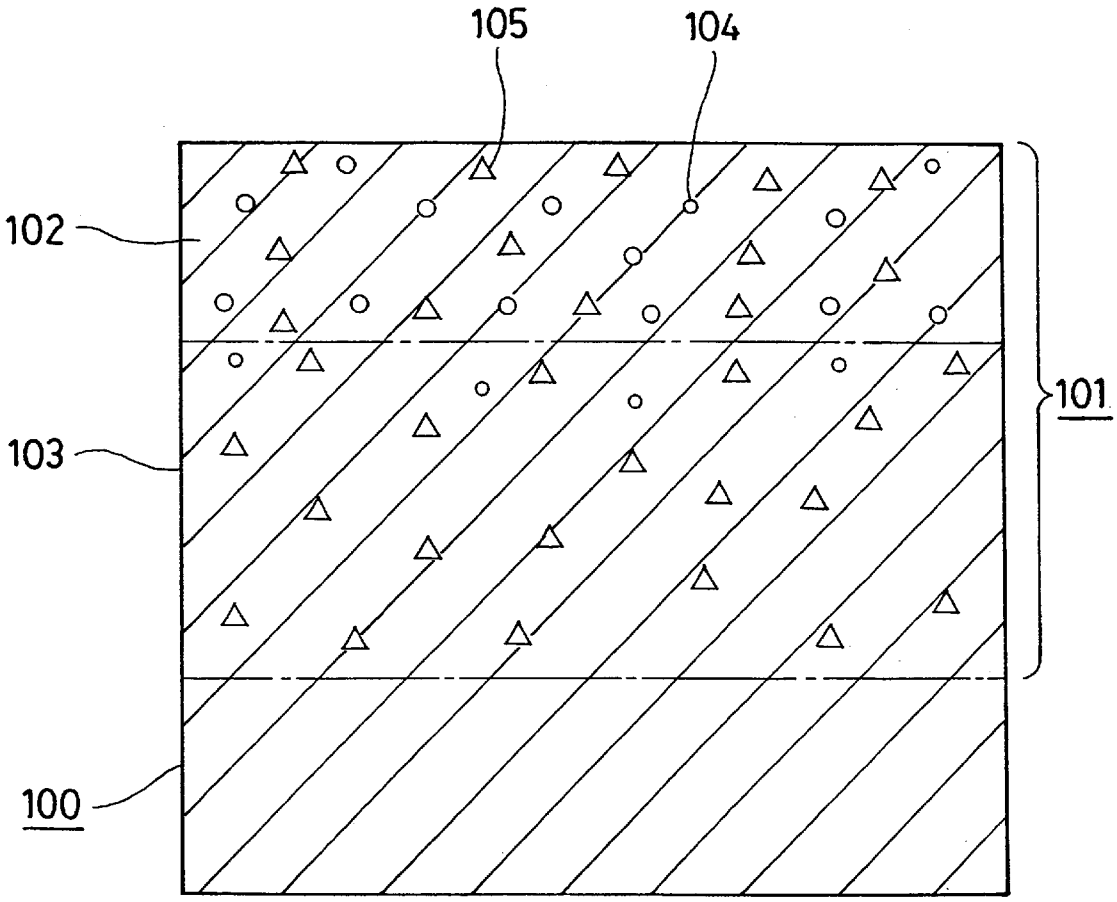
FIG. 2 is a schematic representation showing the structure of a titanium or titanium alloy obtained by the method of the invention.

FIG. 2 is a schematic representation showing the structure of a titanium or titanium alloy obtained by a method of the invention.

As shown in the figure, a hard surface layer 101 is formed in the surface region of a titanium or titanium alloy 100. The hard surface layer 101 extends substantially to a depth of 20 μm from the surface. The hard surface layer 101 can be broken down into a first hard layer 102 where nitrogen atoms 104 and oxygen atoms 105 reside in solid solution, and a second hard layer 103 where oxygen atoms 105 reside in solid solution. The first hard layer 102 is seen lying in a region substantially up to a depth of 1 μm from the surface, and the second hard layer 103 in a region deeper than the former.

In particular, the first hard layer 102 containing nitrogen atoms 104 and oxygen atoms 105 in solid solution has high hardness, and a function of preventing the surface of the titanium or titanium alloy from being scratched while the second hard layer 103 has a function of enhancing impact resistance by expanding the hardened region to depths of the titanium or titanium alloy.

Figure 3:
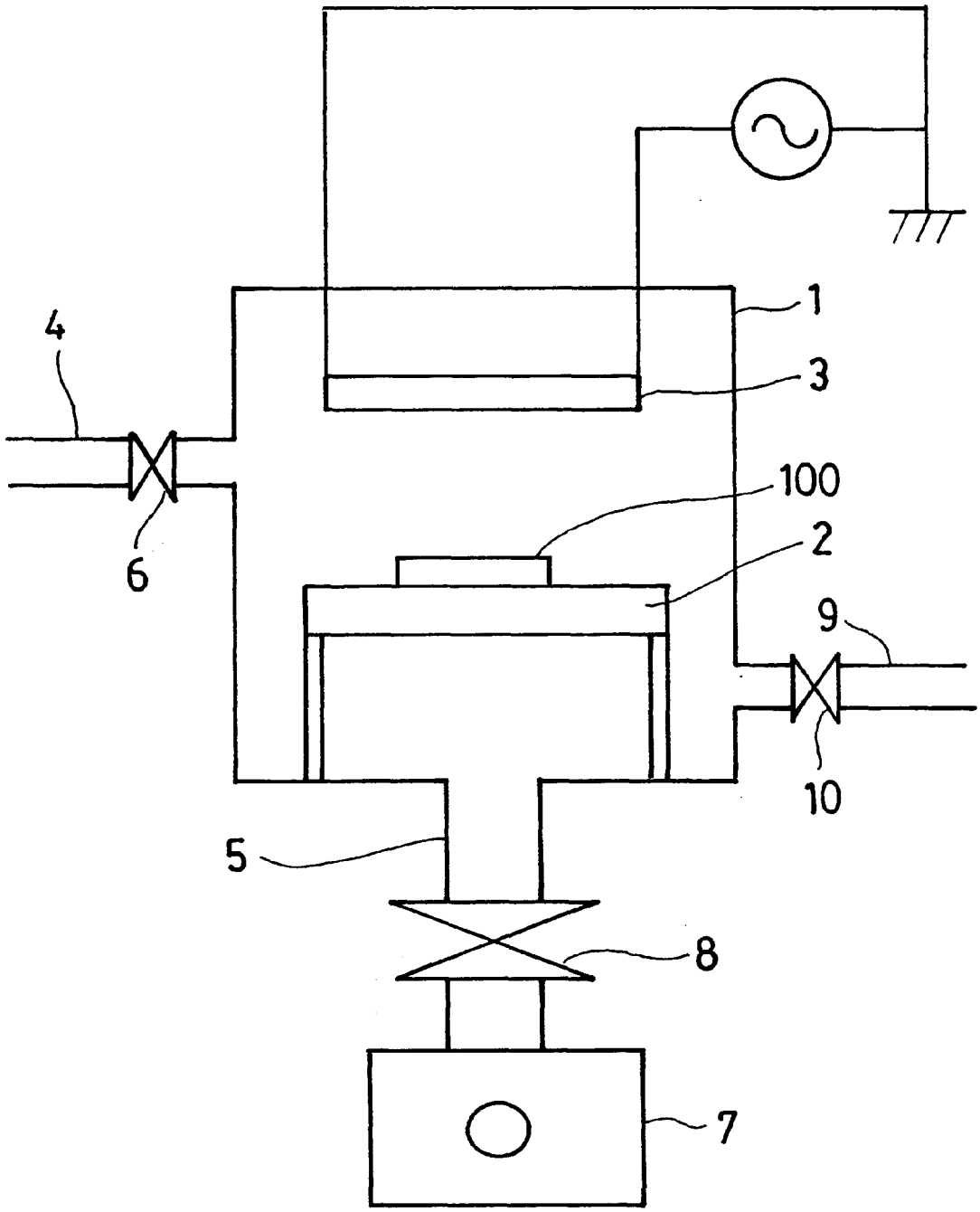
FIG. 3 is a schematic representation showing an apparatus for applying surface treatment, used by the inventors in carrying out embodiments of the invention.

FIG. 3 is a schematic representation of a surface treatment apparatus used by the inventor in carrying out the embodiments.

The surface treatment apparatus shown in the figure is constructed so as to incorporate a vacuum vessel 1 at the center thereof. A tray 2 for placing the titanium or titanium alloy 100 thereon, and a heater 3 as a heating means are disposed inside the vacuum vessel 1.

Further, a gas conduit 4 and a gas exhaust pipe 5 are connected to the vacuum vessel 1. The gas conduit 4 is linked with a gas supply source (not shown). A gas inlet valve 6 is installed in the gas conduit 4 so that gas as required can be fed into the vacuum vessel 1 by opening the gas inlet valve 6. Meanwhile, the gas exhaust pipe 5 is linked with a vacuum pump 7 so that the gas inside the vacuum vessel 1 can be evacuated by the pumping force of the vacuum pump 7. An electromagnetic valve 8 is installed in the gas exhaust pipe 5 for controlling the execution and stoppage of evacuation action of the vacuum pump 7.

Further, a release pipe 9 open to the atmosphere is connected to the vacuum vessel 1, and by opening a vent valve 10 installed in the release pipe 9, the pressure inside the vacuum vessel 1 can be rendered equal to atmospheric pressure.

In embodiments 1 to 7, described hereinafter, surface treatment is applied to the titanium or titanium alloy 100 so as to have a structure as shown in FIG. 2 after a heating process, hardening treatment process, and cooling process. In the hardening treatment process, a mixed gas consisting primarily of nitrogen with a trace of oxygen mixed therein is fed into the vacuum vessel 1 as a reacting gas. In respective embodiments, the reacting gas is adjusted to have a different composition.

In embodiments 1 to 5, the hardening treatment process was applied in a reduced pressure atmosphere while in embodiments 6 and 7, the hardening treatment process was applied under ambient atmospheric pressure.

Embodiment 1

After evacuating the vacuum vessel 1 via the gas exhaust pipe 5 to a high degree of vacuum at $1\times10^{-5}$ Torr or less for eliminating the effect of any remaining atmospheric gas, the titanium or titanium alloy 100 is heated at a temperature in the range of 650 to 830° C. by the heater 3.

After maintaining such a heating condition as above for 30 minutes, an annealing treatment was applied to the titanium or titanium alloy 100 (heating process).

Subsequently, a mixed gas containing 99.5% nitrogen with 5000 ppm (0.5%) of oxygen added thereto was fed into the vacuum vessel 1 as a reacting gas through the gas conduit 4. Then, heating was continued for 5 hours, adjusting the internal pressure of the vacuum vessel 1 to 0.2 Torr while substantially maintaining the temperature (650 to 830° C.) at which the annealing treatment was applied (hardening treatment process).

By means of the hardening treatment process, nitrogen atoms 104 and oxygen atoms 105 are caused to be adsorbed to and diffused into the surface of the titanium or titanium alloy 100, and simultaneously, to be extended from the surface to the interior thereof in solid solution, thereby forming the hard surface layer 101 consisting of the first hard layer 102 and the second hard layer 103 (refer to FIG. 2).

Thereafter, supply of the mixed gas was stopped, and the titanium or titanium alloy 100 was cooled to room temperature while continuing evacuation of the vacuum vessel 1 (cooling process).

In embodiment 1, a mirror polished testpiece prepared from titanium material, class 2 as defined by JIS, was used for the titanium or titanium alloy (workpiece to be treated).

A heating process and hardening treatment process were applied at temperatures in the range of 650 to 830° C. by varying treatment temperatures.

Subsequently, hardness of the testpiece, diffusion depths and concentration of nitrogen as well as oxygen atoms, surface roughness, and crystal grain sizes in the surface texture were measured and evaluated.

Hardness was measured by use of a Vickers hardness tester, and a Vickers hardness of Hv=750 or higher at a depth of 1.0 μm from the surface was deemed acceptable.

Diffusion depths and concentration of nitrogen atoms and oxygen atoms were measured by use of a secondary ion mass spectrometer (SIMS).

The surface roughness was measured by use of a surface roughness meter, and an average surface roughness Ra of 0.4 μm or less was deemed acceptable.

Crystal grain size Rc was determined by measuring the crystal structure at the surface with an electron microscope, and the same in the range of 20 to 65 μm was deemed acceptable.

Results of these measurements are shown in Table 1.

In Table 1, testpieces numbered S1 to S4 refer to titanium or titanium alloy obtained by varying treatment temperatures in the heating process and hardening treatment process. The testpiece numbered Sc is an unprocessed high purity titanium.

A shown in Table 1, with reference to average surface roughness Ra and crystal grain size Rc after surface hardening treatment is applied, a testpiece S1 (treatment temperature: 650° C.) exhibited excellent quality of appearance, equivalent to those of the unprocessed high purity titanium (testpiece Sc). However, hardness at a depth of 1.0 μm from the surface was found to be as low as Hv=380.

Upon checking nitrogen content at the same depth from the surface, it was found to be 0.05 wt %, indicating that hardly any nitrogen was contained. That is, it is evident from this that the first hard layer shown in FIG. 2 was not formed. Further, oxygen content at a depth of 20 μm from the surface was found to be 0.01 wt %, indicating that the second hard layer was not formed either.

Testpiece S4 (treatment temperature: 830° C.) exhibited hardness as high as Hv=1320 at a depth of 1.0 μm from the surface, but large average surface roughness at Ra=1.0 μm and crystal grain size as coarse as Rc=80 to 200 μm, showing pronounced roughness at the surface thereof.

Surface roughness of such magnitude exceeds the range of allowance for titanium or titanium alloy for use in decorative articles.

On the other hand, testpieces S2 and S3 exhibited such sufficiently high hardness as Hv=820 to 935 at a depth of 1.0 μm from the surface, average surface roughness Ra=0.25 to 0.3 μm and crystal grain size Rc=30 to 60 μm, maintaining excellent quality of appearance, equivalent to that of the unprocessed high purity titanium (testpiece Sc).

Testpieces S2 and S3 contained nitrogen in the range from 0.6 to 8.0 wt % (more specifically, from 0.8 to 1.6 wt %), and oxygen in the range from 1.0 to 14.0 wt % (more specifically, from 1.7 to 2.6 wt %), respectively, from the surface to a depth of 1.0 μm, indicating that the first hard layer shown in FIG. 2 was formed.

Further, oxygen in the range from 0.5 to 14.0 wt % (more specifically, from 0.7 to 1.0 wt %) was contained at a depth of 20 μm from the surface thereof, indicating that the second hard layer shown in FIG. 2 was formed as well.

Figure 4:
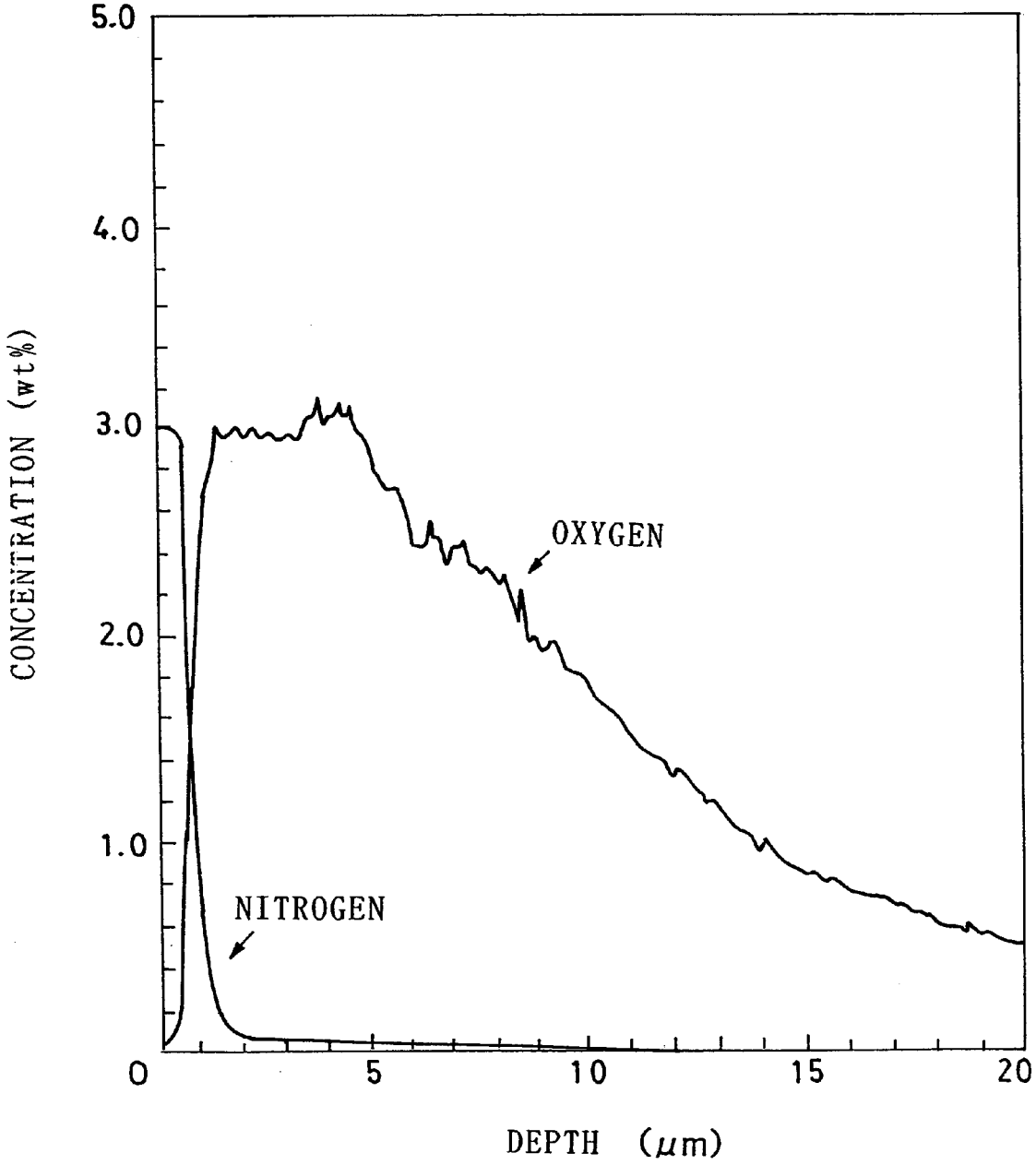
FIGS. 4 and 5 are graphs showing measurements of concentration of nitrogen and oxygen in relation to depths from the surface.

FIG. 4 is a graph showing measurement results of nitrogen content and oxygen content in relation to depths from the surface. Such measurements were made of the titanium or titanium alloy referred to as the testpiece S2.

As is evident from the figure, it is shown that in the titanium or titanium alloy referred to as the testpiece S2 to which surface hardening treatment was applied according to this embodiment, a multitude of nitrogen atoms and oxygen atoms resided in solid solution in a region from the surface up to a depth of 1 μm, and further, a multitude of oxygen atoms resided in solid solution in a deeper region.

Embodiment 2

After evacuating the vacuum vessel 1 via the gas exhaust pipe 5 to a high degree of vacuum at $1\times10^{-5}$ Torr or less for eliminating the effect of any remaining atmospheric gas, the titanium or titanium alloy 100 is heated at a temperature in the range of 650 to 830° C. by the heater 3.

After maintaining such a heating condition as above for 30 minutes, an annealing treatment was applied to the titanium or titanium alloy 100 (heating process).

Subsequently, a mixed gas containing 99.7% of nitrogen with 3000 ppm (0.3%) of water vapor added thereto was fed into the vacuum vessel 1 as a reacting gas through the gas conduit 4. Then, heating was continued for 5 hours, adjusting the internal pressure of the vacuum vessel 1 to 0.25 Torr while substantially maintaining the temperature (650 to 830° C.) at which the annealing treatment was applied (hardening treatment process).

By means of the hardening treatment process, nitrogen atoms 104 and oxygen atoms 105 are caused to be adsorbed to and diffused into the surface of the titanium or titanium alloy 100, and simultaneously, to be extended from the surface to the interior thereof in solid solution, thereby forming the hard surface layer 101 consisting of the first hard layer 102 and the second hard layer 103 (refer to FIG. 2).

Thereafter, supply of the mixed gas was stopped, and the titanium or titanium alloy 100 was cooled to room temperature while continuing evacuation of the vacuum vessel 1 (cooling process).

In embodiment 2 as well, a mirror polished testpiece, prepared from titanium material, JIS class 2, was used for the titanium or titanium alloy (workpiece to be treated).

A heating process and hardening treatment process were applied at temperatures in the range of 650 to 830° C. by varying treatment temperatures.

Subsequently, hardness of the testpiece, diffusion depths and concentration of nitrogen as well as oxygen atoms, surface roughness, and crystal grain sizes in the surface texture were measured and evaluated.

Hardness was measured by use of a Vickers hardness tester, and a Vickers hardness of Hv=750 or higher at a depth of 1.0 μm from the surface was deemed acceptable.

Diffusion depths and concentration of nitrogen atoms and oxygen atoms were measured by use of a secondary ion mass spectrometer (SIMS).

The surface roughness was measured by use of a surface roughness meter, and an average surface roughness Ra of 0.4 μm or less was deemed acceptable.

Crystal grain size Rc was determined by measuring the crystal structure at the surface with an electron microscope, and the same in the range of 20 to 65 μm was deemed acceptable.

Results of these measurements are shown in Table 2.

In Table 2, testpieces numbered S5 to S8 refer to titanium or titanium alloy obtained by varying treatment temperatures in the heating process and hardening treatment process.

As shown in Table 2, with reference to average surface roughness Ra and crystal grain size Rc after surface treatment is applied, a testpiece S5 (treatment temperature: 650° C.) exhibited excellent quality of appearance, equivalent to that of the unprocessed high purity titanium (testpiece Sc). However, hardness at a depth of 1.0 μm from the surface was found to be as low as Hv=405.

Upon checking nitrogen content at the same depth from the surface, it was found to be 0.06 wt %, indicating that hardly any nitrogen was contained. That is, it is evident from this that the first hard layer shown in FIG. 2 was not formed. Further, oxygen content at a depth of 20 μm from the surface was found to be 0.01 wt %, indicating that the second hard layer was not formed either.

Testpiece S8 (treatment temperature: 830 ° C.) exhibited hardness as high as Hv=1400 at a depth of 1.0 μm from the surface, but a large average surface roughness at Ra=1.2 μm and crystal grain size as coarse as Rc=80 to 250 μm, showing pronounced roughness at the surface thereof.

Surface roughness of such magnitude exceeds the range of allowance for titanium or titanium alloy for use in decorative articles.

On the other hand, testpieces S6 and S7 exhibited such sufficiently high hardness as Hv=820 to 940 at a depth of 1.0 μm from the surface, average surface roughness Ra=0.25 to 0.3 μm and crystal grain size Rc=30 to 60 μm, maintaining excellent quality of appearance, equivalent to that of the unprocessed high purity titanium (testpiece Sc).

The testpieces S6 and S7 contained nitrogen in the range from 0.6 to 8.0 wt % (more specifically, from 0.9 to 1.6 wt %), and oxygen in the range from 1.0 to 14.0 wt % (more specifically, from 2.0 to 2.5 wt %), respectively, in a region from the surface up to a depth of 1.0 μm, indicating that the first hard layer shown in FIG. 2 was formed.

Further, oxygen in the range from 0.5 to 14.0 wt % (more specifically, from 0.8 to 1.2 wt %) was contained at a depth of 20 μm from the surface thereof, indicating that the second hard layer shown in FIG. 2 was formed as well.

Figure 5:
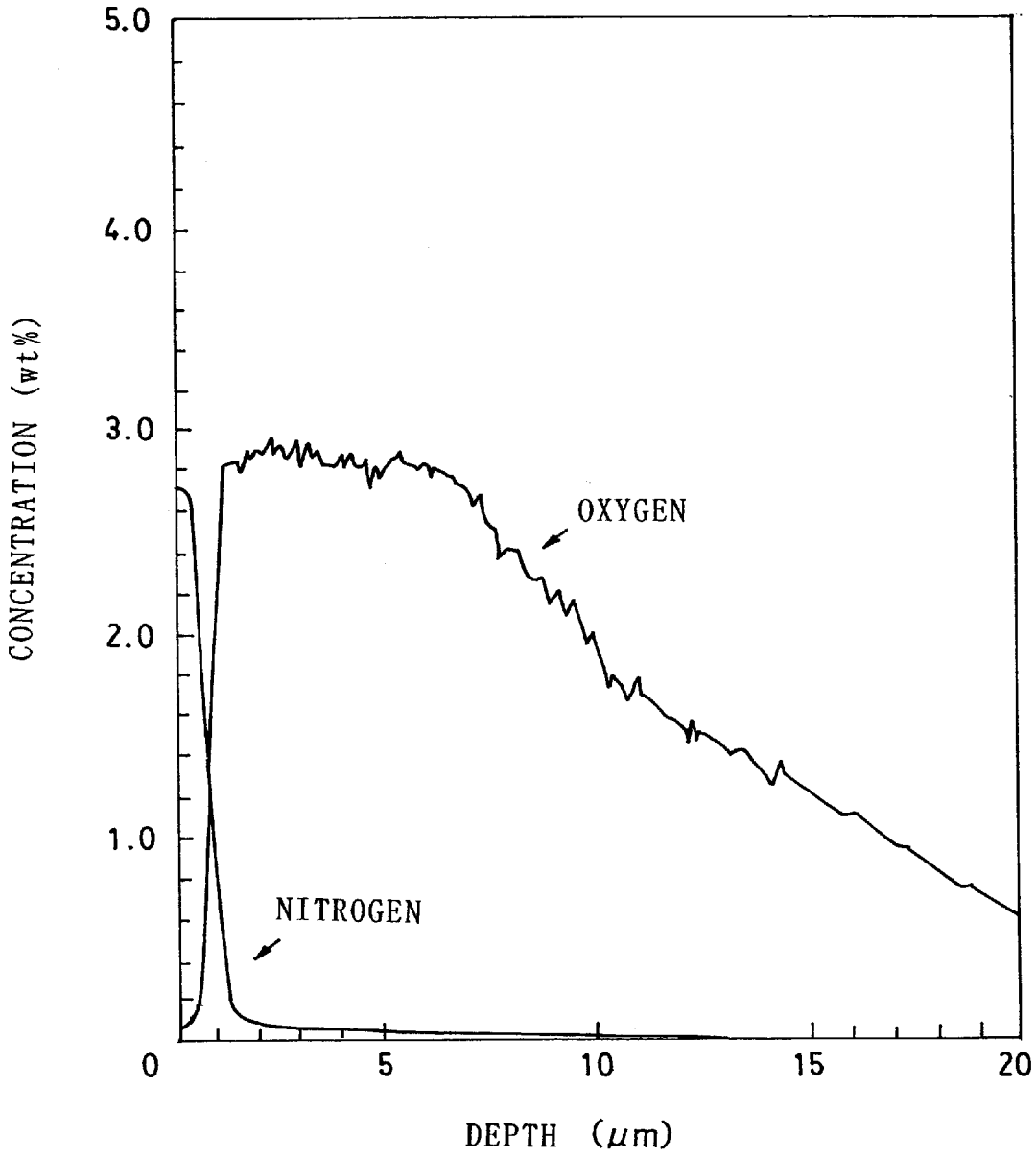

FIG. 5 is a graph showing measurement results of nitrogen content and oxygen content in relation to depths from the surface. Such measurements were made of the titanium or titanium alloy referred to as the testpiece S6.

As is evident from the figure, it is shown that in the titanium or titanium alloy referred to as testpiece S6 to which a surface hardening treatment was applied according to this embodiment, a multitude of nitrogen atoms and oxygen atoms resided in solid solution in a region from the surface up to a depth of 1 μm, and further, a multitude of oxygen atoms resided in solid solution in a deeper region.

Embodiment 3

After evacuating the vacuum vessel 1 via the gas exhaust pipe 5 to a high degree of vacuum at $1\times10^{-5}$ Torr or less for eliminating the effect of any remaining atmospheric gas, the titanium or titanium alloy 100 was heated at a temperature in the range of 650 to 830° C. by the heater 3.

After maintaining such a heating condition as above for 30 minutes, an annealing treatment was applied to the titanium or titanium alloy 100 (heating process).

Subsequently, a mixed gas containing 99.4% of nitrogen with 2000 ppm (0.2%) of oxygen and 4000 ppm (0.4%) of hydrogen, respectively, added thereto was fed into the vacuum vessel 1 as a reacting gas through the gas conduit 4. Then, heating was continued for 5 hours, adjusting the internal pressure of the vacuum vessel 1 to 0.2 Torr while substantially maintaining the temperature (650 to 830° C.) at which the annealing treatment was applied (hardening treatment process).

By means of the hardening treatment process, nitrogen atoms 104 and oxygen atoms 105 were caused to be adsorbed to and diffused into the surface of the titanium or titanium alloy 100, and simultaneously, to be extended from the surface to the interior thereof in solid solution, thereby forming the hard surface layer 101 consisting of the first hard layer 102 and the second hard layer 103 (refer to FIG. 2).

Thereafter, supply of the mixed gas was stopped, and the titanium or titanium alloy 100 was cooled to room temperature while continuing evacuation of the vacuum vessel 1 (cooling process).

In the embodiment 3 as well, a mirror polished testpiece prepared from titanium material, JIS class 2, was used for the titanium or titanium alloy (workpiece to be treated).

A heating process and hardening treatment process were applied at temperatures in the range of 650 to 830° C. by varying treatment temperatures.

Subsequently, hardness, surface roughness, and crystal grain sizes in the surface texture were measured and evaluated.

Hardness was measured by use of a Vickers hardness tester, and a Vickers hardness of Hv=750 or higher at a depth of 1.0 μm from the surface was deemed acceptable.

The surface roughness was measured by use of a surface roughness meter, and an average surface roughness Ra of 0.4 μm or less was deemed acceptable.

Crystal grain size Rc was determined by measuring the crystal structure at the surface with an electron microscope, and the same in the range of 20 to 65 μm was deemed acceptable.

Results of these measurements are shown in Table 3.

In Table 3, testpieces numbered S9 to S12 refer to titanium or titanium alloy obtained by varying treatment temperatures in the heating process and hardening treatment process.

A shown in Table 3, with reference to average surface roughness Ra and crystal grain size Rc after surface treatment is applied, testpiece S9 (treatment temperature: 650° C.) exhibited excellent quality of appearance, equivalent to that of the unprocessed high purity titanium (testpiece Sc). However, hardness at a depth of 1.0 μm from the surface was found to be as low as Hv=370.

Testpiece S12 (treatment temperature: 830° C.) exhibited hardness as high as Hv=1300 at a depth of 1.0 μm from the surface, but large average surface roughness at Ra=1.1 μm and crystal grain size as coarse as Rc=80 to 200 μm, showing pronounced roughness at the surface thereof.

The surface roughness of such magnitude exceeds the range of allowance for titanium or titanium alloy for use in decorative articles.

On the other hand, testpieces S10 and S11 exhibited such sufficiently high hardness as Hv=810 to 920 at a depth of 1.0 μm from the surface, an average surface roughness Ra=0.25 to 0.3 μm and crystal grain size Rc=30 to 60 μm, maintaining excellent quality of appearance, equivalent to that of the unprocessed high purity titanium (testpiece Sc).

The results show that the testpieces S11 and S12 contained nitrogen in the range from 0.6 to 8.0 wt %, and oxygen in the range from 1.0 to 14.0 wt %, respectively, in a region from the surface up to a depth of 1.0 μm, as in the case of the titanium or titanium alloy referred to as testpieces S2 and S3 used in embodiment 1 described in the foregoing, and it is therefore easily deduced that the first hard layer shown in FIG. 2 was formed.

Further, oxygen in the range from 0.5 to 14.0 wt % was contained at a depth of 20 μm from the surface thereof, and it is also easily deduced that the second hard layer shown in FIG. 2 was formed.

Embodiment 4

After evacuating the vacuum vessel 1 via the gas exhaust pipe 5 to a high degree of vacuum at $1\times10^{-5}$ Torr or less for eliminating the effect of any remaining atmospheric gas, the titanium or titanium alloy 100 was heated at a temperature in the range of 650 to 830° C. by the heater 3.

After maintaining such a heating condition as above for 30 minutes, an annealing treatment was applied to the titanium or titanium alloy 100 (heating process).

Subsequently, a mixed gas containing 99.7% of nitrogen with 2500 ppm (0.25%) of water vapor and 500 ppm (0.05%) of carbon dioxide, respectively, added thereto was fed into the vacuum vessel 1 as a reacting gas through the gas conduit 4. Then, heating was continued for 5 hours, adjusting the internal pressure of the vacuum vessel 1 to 0.25 Torr while substantially maintaining the temperature (650 to 830° C.) at which the annealing treatment was applied (hardening treatment process).

By means of the hardening treatment process, nitrogen atoms 104 and oxygen atoms 105 were caused to be adsorbed to and diffused into the surface of the titanium or titanium alloy 100, and simultaneously, to be extended from the surface to the interior thereof in solid solution, thereby forming the hard surface layer 101 consisting of the first hard layer 102 and the second hard layer 103 (refer to FIG. 2).

Thereafter, supply of the mixed gas was stopped, and the titanium or titanium alloy 100 was cooled to room temperature while continuing evacuation of the vacuum vessel 1 (cooling process).

In embodiment 4 as well, a mirror polished testpiece prepared from titanium material, JIS class 2, was used for the titanium or titanium alloy (workpiece to be treated).

The heating process and hardening treatment process were applied at temperatures in the range of 650 to 830° C. by varying treatment temperatures.

Subsequently, hardness, surface roughness, and crystal grain sizes in the surface texture were measured and evaluated.

Hardness was measured by use of a Vickers hardness tester, and a Vickers hardness of Hv=750 or higher at a depth of 1.0 μm from the surface was deemed acceptable.

The surface roughness was measured by use of a surface roughness meter, and an average surface roughness Ra of 0.4 μm or less was deemed acceptable.

Crystal grain size Rc was determined by measuring the crystal structure at the surface with an electron microscope, and the same in the range of 20 to 65 μm was deemed acceptable.

Results of these measurements are shown in Table 4.

In Table 4, testpieces numbered S13 to S16 refer to titanium or titanium alloy obtained by varying treatment temperatures in the heating process and hardening treatment process.

A shown in Table 4, with reference to average surface roughness Ra and crystal grain size Rc after surface treatment is applied, testpiece S13 (treatment temperature: 650° C.) exhibited excellent quality of appearance, equivalent to that of the unprocessed high purity titanium (testpiece Sc). However, hardness at a depth of 1.0 μm from the surface was found to be as low as Hv=340.

Testpiece S16 (treatment temperature: 830° C.) exhibited hardness as high as Hv=1240 at a depth of 1.0 μm from the surface, but large average surface roughness at Ra=1.0 μm and crystal grain size as coarse as Rc=80 to 200 μm, showing pronounced roughness at the surface thereof.

The surface roughness of such magnitude exceeds the range of allowance for titanium or titanium alloy for use in decorative articles.

On the other hand, testpieces S14 and S15 exhibited such sufficiently high hardness as Hv=800 to 850 at a depth of 1.0 μm from the surface, average surface roughness Ra=0.25 to 0.3 μm and crystal grain size Rc=30 to 60 μm, maintaining excellent quality of appearance, equivalent to that of the unprocessed high purity titanium (testpiece Sc).

The results show that testpieces S14 and S15 contained nitrogen in the range from 0.6 to 8.0 wt %, and oxygen in the range from 1.0 to 14.0 wt %, respectively, in a region up to a depth of 1.0 μm from the surface, as in the case of the titanium or titanium alloy referred to as testpieces S2 and S3 used in embodiment 1 described in the foregoing, and it is therefore easily deduced that the first hard layer shown in FIG. 2 was formed.

Further, oxygen in the range from 0.5 to 14.0 wt % was contained at a depth of 20 μm from the surface thereof, and it is also easily deduced that the second hard layer shown in FIG. 2 was formed.

Embodiment 5

After evacuating the vacuum vessel 1 via the gas exhaust pipe 5 to a high degree of vacuum at $1\times10^{-5}$ Torr or less for eliminating the effect of any remaining atmospheric gas, the titanium or titanium alloy 100 was heated at a temperature in the range of 650 to 830° C. by the heater 3.

After maintaining such a heating condition as above for 30 minutes, an annealing treatment was applied to the titanium or titanium alloy 100 (heating process).

Subsequently, a mixed gas containing 99.3% of nitrogen with 7000 ppm (0.7%) of an ethyl alcohol gas added thereto was fed into the vacuum vessel 1 as a reacting gas through the gas conduit 4. Then, heating was continued for 5 hours, adjusting the internal pressure of the vacuum vessel 1 to 0.1 Torr while substantially maintaining the temperature (650 to 830° C.) at which the annealing treatment was applied (hardening treatment process).

By means of the hardening treatment process, nitrogen atoms 104 and oxygen atoms 105 were caused to be adsorbed to and diffused into the surface of the titanium or titanium alloy 100, and simultaneously, to be extended from the surface to the interior thereof in solid solution state, thereby forming the hard surface layer 101 consisting of the first hard layer 102 and the second hard layer 103 (refer to FIG. 2).

Thereafter, supply of the mixed gas was stopped, and the titanium or titanium alloy 100 was cooled to room temperature while continuing evacuation of the vacuum vessel 1 (cooling process).

In the embodiment 5 as well, a mirror polished testpiece, prepared from titanium material, JIS class 2, was used for the titanium or titanium alloy (workpiece to be treated).

The heating process and hardening treatment process were applied at temperatures in the range of 650 to 830° C. by varying treatment temperatures.

Subsequently, hardness, surface roughness, and crystal grain sizes in the surface texture were measured and evaluated.

Hardness was measured by use of a Vickers hardness tester, and a Vickers hardness of Hv=750 or higher at a depth of 1.0 μm from the surface was deemed acceptable.

The surface roughness was measured by use of a surface roughness meter, an average surface roughness Ra of 0.4 μm or less was deemed acceptable.

Crystal grain size Rc was determined by measuring a crystal structure at the surface with an electron microscope, and the same in the range of 20 to 65 μm was deemed acceptable.

Results of these measurements are shown in Table 5.

In Table 5, testpieces numbered S17 to S20 refer to titanium or titanium alloy obtained by varying treatment temperatures in the heating process and hardening treatment process.

A shown in Table 5, with reference to average surface roughness Ra and crystal grain size Rc after surface treatment is applied, testpiece S17 (treatment temperature: 650° C.) exhibited excellent quality of appearance, equivalent to that of the unprocessed high purity titanium (testpiece Sc). However, hardness at a depth of 1.0 μm from the surface was found to be as low as Hv=330.

A testpiece S20 (treatment temperature: 830° C.) exhibited hardness as high as Hv=1200 at a depth of 1.0 μm from the surface, but large average surface roughness at Ra=1.0 μm and crystal grain size as coarse as Rc=80 to 180 μm, showing pronounced roughness at the surface thereof.

The surface roughness of such magnitude exceeds a range of allowance for titanium or titanium alloy for use in decorative articles.

On the other hand, testpieces S18 and S19 exhibited such sufficiently high hardness as Hv=780 to 830 at a depth of 1.0 μm from the surface, average surface roughness Ra=0.25 to 0.3 μm and crystal grain size Rc=30 to 60 μm, maintaining excellent quality of appearance, equivalent to that of the unprocessed high purity titanium (testpiece Sc).

The results show that testpieces S18 and S19 contained nitrogen in the range from 0.6 to 8.0 wt %, and oxygen in the range from 1.0 to 14.0 wt %, respectively, in a region from the surface up to a depth of 1.0 μm, as in the case of the titanium or titanium alloy referred to as testpieces S2 and S3 used in embodiment 1 described in the foregoing, and it is therefore easily deduced that the first hard layer shown in FIG. 2 was formed.

Further, oxygen in the range from 0.5 to 14.0 wt % was contained at a depth up to 20 μm from the surface thereof, and it is also easily deduced that the second hard layer shown in FIG. 2 was formed.

Embodiment 6

In embodiments 1 to 5 described hereinbefore, the hardening treatment process was applied in a reduced pressure atmosphere while in this embodiment 6 and a succeeding embodiment 7, the hardening treatment process was applied at atmospheric pressure.

After evacuating air from the vacuum vessel 1 via the gas exhaust pipe 5 with the vacuum pump 7 to a degree of vacuum at $1\times10^{-2}$ Torr or less for eliminating the effect of any remaining atmospheric gas, the electromagnetic valve 8 was closed. Subsequently, argon gas (inert gas) was fed into the vacuum vessel 1 via the gas conduit 4 by opening the gas inlet valve 6, and simultaneously, a pressure inside the vacuum vessel 1 is adjusted to match atmospheric pressure by opening the vent valve 10 of the release pipe 9 open to the atmosphere. Under such an atmosphere, an annealing treatment was applied by heating the titanium or titanium alloy 100 at a temperature in the range of 650 to 830° C. for 30 minutes using the heater 3 (heating process).

Thereafter, evacuation of the vacuum vessel 1 using the vacuum pump 7 was performed after opening the electromagnetic valve 8 of the gas exhaust pipe 5 while closing the vent valve 10 of the release pipe 9 open to the atmosphere and the gas inlet valve 6 of the gas conduit 4. Such evacuation was continued until a pressure inside the vacuum vessel 1 dropped to $1\times10^{-2}$ Torr or less.

Thereafter, a mixed gas containing 99.7% of nitrogen with 3000 ppm (0.3%) of water vapor added thereto is fed into the vacuum vessel 1 by opening the gas inlet valve 6 of the gas conduit 4 while closing the electromagnetic valve 8 of the gas exhaust pipe 5. Thereupon, the pressure inside the vacuum vessel 1 was adjusted to match atmospheric pressure by opening the vent valve 10 of the release pipe 9 open to the atmosphere. Then, heating for the duration of 5 hours was carried out, substantially maintaining the temperature (650 to 830° C.) at which the annealing treatment was applied (hardening treatment process).

By means of the hardening treatment process, nitrogen atoms 104 and oxygen atoms 105 were caused to be adsorbed to and diffused into the surface of the titanium or titanium alloy 100, and simultaneously, to be extended from the surface to the interior thereof in solid solution, thereby forming the hard surface layer 101 consisting of the first hard layer 102 and the second hard layer 103 (refer to FIG. 2).

After completion of the hardening treatment process, both the vent valve 10 of the release pipe 9 open to the atmosphere and the gas inlet valve 6 of the gas conduit 4 were closed, and by opening electromagnetic valve 8 of the gas exhaust pipe 5 simultaneously, the vacuum vessel 1 was evacuated to a pressure at $1\times10^{-2}$ Torr or less using the vacuum pump 7 thereby removing the mixed gas.

Subsequently, argon gas was fed into the vacuum vessel 1 by opening the gas inlet valve 6 of the gas conduit 4 while closing the electromagnetic valve 8 of the gas exhaust pipe 5. At the same time, the vent valve 10 of the release pipe 9 open to the atmosphere was opened to adjust the pressure inside the vacuum vessel 1 so as to match atmospheric pressure. Under such atmosphere, the titanium or titanium alloy 100 was cooled to room temperature (cooling process).

In embodiment 6 as well, a mirror polished testpiece prepared from titanium material, JIS class 2, was used for the titanium or titanium alloy (workpiece to be treated).

The heating process and hardening treatment process were applied at temperatures in the range of 650 to 830° C. by varying treatment temperatures.

Subsequently, hardness, surface roughness, and crystal grain sizes in the surface texture were measured and evaluated.

Hardness was measured by use of a Vickers hardness tester, and a Vickers hardness of Hv=750 or higher at a depth of 1.0 μm from the surface was deemed acceptable.

The surface roughness was measured by use of a surface roughness meter, and average surface roughness Ra of 0.4 μm or less was deemed acceptable.

Crystal grain size Rc was determined by measuring a crystal structure at the surface with an electron microscope, and the same in the range of 20 to 65 μm was deemed acceptable.

Results of these measurements are shown in Table 6.

In Table 6, testpieces numbered S21 to S24 refer to titanium or titanium alloy obtained by varying treatment temperatures in the heating process and hardening treatment process.

As shown in Table 6, with reference to average surface roughness Ra and crystal grain size Rc after surface treatment is applied, a testpiece S21 (treatment temperature: 650° C.) exhibited excellent quality of appearance, equivalent to that of the unprocessed high purity titanium (testpiece Sc). However, hardness at a depth of 1.0 μm from the surface was found as low as Hv=360.

Testpiece S24 (treatment temperature: 830° C.) exhibited hardness as high as Hv=1410 at a depth of 1.0 μm from the surface, but large average surface roughness at Ra=1.3 μm and crystal grain size as coarse as Rc=80 to 250 μm, showing pronounced roughness at the surface thereof.

Surface roughness of such magnitude exceeds the range of allowance for titanium or titanium alloy for use in decorative articles.

On the other hand, testpieces S22 and S23 exhibited such sufficiently high hardness as H=840 to 1050 at a depth of 1.0 μm from the surface, average surface roughness Ra=0.25 to 0.35 μm and crystal grain size Rc=30 to 60 μm, maintaining excellent quality of appearance, equivalent to that of the unprocessed high purity titanium (testpiece Sc).

The results show that testpieces S22 and S23 contained nitrogen in the range from 0.6 to 8.0 wt %, and oxygen in the range from 1.0 to 14.0 wt %, respectively, in a region from the surface up to a depth of 1.0 μm, as in the case of the titanium or titanium alloy referred to as testpieces S2 and S3 used in embodiment 1 described in the foregoing, and it is therefore easily deduced that the first hard layer shown in FIG. 2 was formed.

Further, oxygen in the range from 0.5 to 14.0 wt % was contained at a depth up to 20 μm from the surface thereof, and it is also easily deduced that the second hard layer shown in FIG. 2 was formed.

Embodiment 7

After evacuating air from the vacuum vessel 1 via the gas exhaust pipe 5 with the vacuum pump 7 to a degree of vacuum at $1\times10^{-2}$ Torr or less for eliminating the effect of any remaining atmospheric gas, the electromagnetic valve 8 was closed. Subsequently, helium gas (inert gas) was fed into the vacuum vessel 1 via the gas conduit 4 by opening the gas inlet valve 6, and simultaneously, the pressure inside the vacuum vessel 1 was adjusted to match atmospheric pressure by opening the vent valve 10 of the release pipe 9 open to the atmosphere. In such an atmosphere, an annealing treatment was applied by heating the titanium or titanium alloy 100 at a temperature in the range of 650 to 830° C. for 30 minutes using the heater 3 (heating process).

Thereafter, evacuation of the vacuum vessel 1 using the vacuum pump 7 was performed after opening the electromagnetic valve 8 of the gas exhaust pipe 5 while closing the vent valve 10 of the release pipe 9 open to the atmosphere and the gas inlet valve 6 of the gas conduit 4. Such evacuation was continued until the pressure inside the vacuum vessel 1 dropped to $1\times10^{-2}$ Torr or less.

Thereafter, a mixed gas containing 99.7% of nitrogen with 3000 ppm (0.3%) of oxygen added thereto was fed into the vacuum vessel 1 by opening the gas inlet valve 6 of the gas conduit 4 while closing the electromagnetic valve 8 of the gas exhaust pipe 5. Thereupon, the pressure inside the vacuum vessel 1 was adjusted to match atmospheric pressure by opening the vent valve 10 of the release pipe 9 open to the atmosphere. Then, heating for the duration of 5 hours was carried out, substantially maintaining the temperature (650 to 830° C.) at which the annealing treatment was applied (hardening treatment process).

By means of the hardening treatment process, nitrogen atoms 104 and oxygen atoms 105 were caused to be adsorbed to and diffused into the surface of the titanium or titanium alloy 100, and simultaneously, to be extended from the surface to the interior thereof in solid solution, thereby forming the hard surface layer 101 consisting of the first hard layer 102 and the second hard layer 103 (refer to FIG. 2).

After completion of the hardening treatment process, both the vent valve 10 of the release pipe 9 open to the atmosphere and the gas inlet valve 6 of the gas conduit 4 were closed, and by simultaneously opening electromagnetic valve 8 of the gas exhaust pipe 5, the vacuum vessel 1 was evacuated to a pressure of $1\times10^{-2}$ Torr or less using the vacuum pump 7 thereby removing the mixed gas.

Subsequently, helium gas was fed into the vacuum vessel 1 by opening the gas inlet valve 6 of the gas conduit 4 while closing the electromagnetic valve 8 of the gas exhaust pipe 5. At the same time, the vent valve 10 of the release pipe 9 open to the atmosphere was opened to adjust the pressure inside the vacuum vessel 1 so as to match atmospheric pressure. Under such atmosphere, the titanium or titanium alloy 100 was cooled to room temperature (cooling process).

In the embodiment 7 as well, a mirror polished testpiece, prepared from titanium material, JIS class 2, was used for the titanium or titanium alloy (workpiece to be treated).

The heating process and hardening treatment process were applied at temperatures in the range of 650 to 830° C. by varying treatment temperatures.

Subsequently, hardness, surface roughness, and crystal grain sizes in the surface texture were measured and evaluated.

Hardness was measured by use of a Vickers hardness tester, and a Vickers hardness of Hv=750 or higher at a depth of 1.0 μm from the surface was deemed acceptable.

The surface roughness was measured by use of a surface roughness meter, and an average surface roughness Ra of 0.4 μm or less was deemed acceptable.

Crystal grain size Rc was determined by measuring a crystal structure at the surface with an electron microscope, and the same in the range of 20 to 65 μm was deemed acceptable.

Results of these measurements are shown in Table 7.

In Table 7, testpieces numbered S25 to S28 refer to titanium or titanium alloy obtained by varying treatment temperatures in the heating process and hardening treatment process.

A shown in Table 7, with reference to average surface roughness Ra and crystal grain size Rc after surface treatment is applied, a testpiece S25 (treatment temperature: 650° C.) exhibited excellent quality of appearance, equivalent to that of the unprocessed high purity titanium (testpiece Sc). However, hardness at a depth of 1.0 μm from the surface was found as low as Hv=330.

Testpiece S28 (treatment temperature: 830° C.) exhibited hardness as high as Hv=1220 at a depth of 1.0 μm from the surface, but large average surface roughness at Ra=1.0 μm and crystal grain size as coarse as Rc=80 to 200 μm, showing pronounced roughness at the surface thereof.

The surface roughness of such magnitude exceeds the range of allowance for titanium or titanium alloy for use in decorative articles.

On the other hand, testpieces S26 and S27 exhibited such sufficiently high hardness as Hv=780 to 840 at a depth of 1.0 μm from the surface, average surface roughness Ra=0.25 to 0.3 μm and crystal grain size Rc=30 to 60 μm, maintaining excellent quality of appearance, equivalent to that of the unprocessed high purity titanium (testpiece Sc).

The results show that testpieces S26 and S27 contained nitrogen in the range from 0.6 to 8.0 wt %, and oxygen in the range from 1.0 to 14.0 wt %, respectively, in a region up to a depth of 1.0 μm from the surface, as in the case of the titanium or titanium alloy referred to as testpieces S2 and S3 used in embodiment 1 described in the foregoing, and it is therefore easily deduced that the first hard layer shown in FIG. 2 was formed.

Further, oxygen in the range from 0.5 to 14.0 wt % was contained at a depth up to 20 μm from the surface thereof, and it is also easily deduced that the second hard layer shown in FIG. 2 was formed.

While the invention has been particularly shown and described with reference to preferred embodiments thereof, it is to be understood that the invention is not limited thereto and that modifications will occur to those skilled in the art without departing from the spirit and scope of the invention.

In the respective embodiments described in the foregoing, the titanium or titanium alloy was heated by use of the heater 3 so as to cause nitrogen and oxygen to be contained therein in a solid solution. Alternatively, however, the titanium or titanium alloy may be caused to contain nitrogen and oxygen in a solid solution by utilizing, for example, a plasma.

Further, the mixed gas consisting primarily of nitrogen with a trace of oxygen that was fed into the vacuum vessel 1 during the hardening treatment process need not be limited to those used in the respective embodiments. For example, use may be made of a nitrogen gas combined with an oxygen-containing gas such as nitrogen monoxide, nitrogen dioxide, carbon monoxide, and carbon dioxide. In addition, a trace of an inert gas such as helium, neon, argon, and a trace of a gas containing hydrogen, boron, and carbon may be added thereto.

With the respective embodiments described in the foregoing, in the heating process, the titanium or titanium alloy was heated in a vacuum-like atmosphere after evacuating the vacuum vessel 1 to a high degree of vacuum, and thereafter applying the annealing treatment thereto. However, the heating process may be performed not only in a vacuum-like atmosphere but also in an atmosphere of an inert gas such as helium, argon, or the like that does not react with the titanium or titanium alloy. In the latter case, however, it is desirable to keep the inside of the vacuum vessel 1 in a reduced pressure condition.

Meanwhile, the heating process was performed in an argon atmosphere at atmospheric pressure in embodiment 6, and in a helium atmosphere at atmospheric pressure in embodiment 7. However, the heating process may be performed not only in these atmospheres but also in a vacuum-like atmosphere.

With the respective embodiments described above, the treatment time during the heating process was set at 30 minutes. However, the same need not be limited to that and may be set at any suitable length of time in the range from 30 minutes to 2 hours.

Further, with the respective embodiments described above, the treatment time during the hardening treatment process was set at 5 hours. However, the same need not be limited to that and may be set at any suitable length of time as necessary.

If, however, the treatment time during the hardening treatment process is less than 1 hour, there is a risk that sufficient hardness cannot be obtained due to lack of sufficient progress taking place in diffusion of and transition to a solid solution of nitrogen as well as oxygen atoms. On the other hand, if the treatment time during the hardening treatment process is in excess of 10 hours, there is a risk that the surface of the titanium or titanium alloy becomes coarse. Accordingly, the length of treatment time during the hardening treatment process should preferably be set within the range from 1 to 10 hours.

Furthermore, with the respective embodiments 1 to 5 as described above, the cooling process was performed while evacuating the vacuum vessel 1 to a high degree of vacuum. However, the cooling process may be performed not only in a vacuum-like atmosphere but also in an atmosphere of an inert gas such as helium, argon, or the like that does not react with the titanium or titanium alloy. In the latter case, however, it is desirable to keep the inside of the vacuum vessel 1 in a reduced pressure condition.

Meanwhile, the cooling process was performed in an argon atmosphere at atmospheric pressure in embodiment 6, and in a helium atmosphere at atmospheric pressure in embodiment 7. However, the cooling process may be applied not only in these atmospheres but also in a vacuum-like atmosphere.

TABLE 1

| testpiece no. | S1 | S2 | S3 | S4 | Sc |
|---|---|---|---|---|---|
| treatment temp. (° C.) | 650 | 730 | 780 | 830 | unprocessed |
| hardness at depth of 1.0 μm from surface (Hv) | 380 | 820 | 935 | 1320 | 180 |
| nitrogen conc. at depth of 1.0 μm (wt %) | 0.05 | 0.8 | 1.6 | 2.1 | — |
| oxygen conc. at depth of 1.0 μm (wt %) | 2.0 | 2.6 | 1.7 | 2.2 | — |
| oxygen conc. at depth of 20 μm (wt %) | 0.01 | 0.7 | 1.0 | 1.5 | — |
| avg. surface roughness Ra (μm) after treatment | 0.2 | 0.25 | 0.3 | 1.0 | 0.2 |
| crystal grain size Rc (μm) after treatment | 20 to 50 | 30 to 60 | 30 to 60 | 80 to 200 | 20 to 50 |
| assessment results | x | ○ | ○ | x | — |

TABLE 2

| testpiece no. | S5 | S6 | S7 | S8 | Sc |
|---|---|---|---|---|---|
| treatment temp. (° C.) | 650 | 730 | 780 | 830 | unprocessed |
| hardness at depth of 1.0 μm from surface (Hv) | 405 | 820 | 940 | 1400 | 180 |
| nitrogen con. at depth of (wt %) | 0.06 | 0.9 | 1.6 | 2.4 | — |
| oxygen conc. at depth of 1.0 μm (wt %) | 1.9 | 2.5 | 2.0 | 2.0 | — |
| oxygen conc. at depth of 20 μm (wt %) | 0.01 | 0.8 | 1.2 | 1.4 | — |
| avg. surface roughness Ra (μm) after treatment | 0.2 | 0.25 | 0.3 | 1.2 | 0.2 |
| crystal grain size Rc (μm) after treatment | 20 to 50 | 30 to 60 | 30 to 60 | 80 to 250 | 20 to 50 |
| assessment results | x | ○ | ○ | x | — |

TABLE 3

| testpiece no. | S9 | S10 | S11 | S12 | Sc |
|---|---|---|---|---|---|
| treatment temp. (° C.) | 650 | 730 | 780 | 830 | unprocessed |
| hardness at depth of 1.0 μm from surface (Hv) | 370 | 810 | 920 | 1300 | 180 |

TABLE 3-continued

| testpiece no. | S9 | S10 | S11 | S12 | Sc |
|---|---|---|---|---|---|
| avg. surface roughness Ra (μm) after treatment | 0.2 | 0.25 | 0.3 | 1.1 | 0.2 |
| crystal grain size Rc (μm) after treatment | 20 to 50 | 30 to 60 | 30 to 60 | 80 to 200 | 20 to 50 |
| assessment results | x | ○ | ○ | x | — |

TABLE 4

| testpiece no. | S13 | S14 | S15 | S16 | Sc |
|---|---|---|---|---|---|
| treatment temp. (° C.) | 650 | 730 | 780 | 830 | unprocessed |
| hardness at depth of 1.0 μm from surface (Hv) | 340 | 800 | 850 | 1240 | 180 |
| avg. surface roughness Ra (μm) after treatment | 0.2 | 0.25 | 0.3 | 1.0 | 0.2 |
| crystal grain size Rc (μm) after treatment | 20 to 50 | 30 to 60 | 30 to 60 | 80 to 200 | 20 to 50 |
| assessment results | x | ○ | ○ | x | — |

TABLE 5

| testpiece no. | S17 | S18 | S19 | S20 | Sc |
|---|---|---|---|---|---|
| treatment temp. (° C.) | 650 | 730 | 780 | 830 | unprocessed |
| hardness at depth of 1.0 μm from surface (Hv) | 330 | 780 | 830 | 1200 | 180 |
| avg. surface roughness Ra (μm) after treatment | 0.2 | 0.25 | 0.3 | 1.0 | 0.2 |
| crystal grain size Rc (μm) after treatment | 20 to 50 | 30 to 55 | 30 to 60 | 80 to 180 | 20 to 50 |
| assessment results | x | ○ | ○ | x | — |

TABLE 6

| testpiece no. | S21 | S22 | S23 | S24 | Sc |
|---|---|---|---|---|---|
| treatment temp. (° C.) | 650 | 730 | 780 | 830 | unprocessed |
| hardness at depth of 1.0 μm from surface (Hv) | 360 | 840 | 1050 | 1410 | 180 |
| avg. surface roughness Ra (μm) after treatment | 0.2 | 0.25 | 0.35 | 1.3 | 0.2 |
| crystal grain | | | | | |

TABLE 6-continued

| testpiece no. | S21 | S22 | S23 | S24 | Sc |
|---|---|---|---|---|---|
| size Rc (μm) after treatment | 20 to 50 | 30 to 60 | 30 to 60 | 80 to 250 | 20 to 50 |
| assessment results | x | ○ | ○ | x | — |

TABLE 7

| testpiece no. | S25 | S26 | S27 | S28 | Sc |
|---|---|---|---|---|---|
| treatment temp. (° C.) | 650 | 730 | 780 | 830 | unprocessed |
| hardness at depth of 1.0 μm from surface (Hv) | 330 | 780 | 840 | 1220 | 180 |
| avg. surface roughness Ra (μm) after treatment | 0.2 | 0.25 | 0.3 | 1.0 | 0.2 |
| crystal grain size Rc (μm) after treatment | 20 to 50 | 30 to 60 | 30 to 60 | 80 to 200 | 20 to 50 |
| assessment results | x | ○ | ○ | x | — |

Industrial Utilization

The titanium or titanium alloy according to the invention has high quality in appearance and yet sufficient hardness, and is therefore suitable for use in decorative articles such as a wristwatch case, wristwatch band, pierced earrings, earrings, a ring, the frame of eyeglasses, and the like. Further, the titanium or titanium alloy having such properties as described can be manufactured on a stable basis by use of the method of surface treating the same, according to the invention.

What is claimed is:

1. A titanium or titanium alloy having a hard surface layer at a depth from a surface thereof, said hard surface layer comprising;

a first hard layer being formed in a region at a depth of 1 μm from the surface and contains nitrogen in solid solution in a range of 0.6 to 8.0 wt % and oxygen in solid solution in a range of 1.0 to 14.0 wt % and a second hard layer being formed in a region at a depth deeper than the first hard layer up to 20 μm from the surface and contains oxygen in solid solution in a range of 0.5 to 14.0 wt %.

2. A titanium or titanium alloy according to claim 1, wherein said first hard layer contains nitrogen in solid solution in a range of 0.9 to 1.6 wt % and oxygen in solid solution in a range of 2.0 to 2.5 wt %, and said second hard layer contains oxygen in solid solution in a range of 0.8 to 1.2 wt %, and hardness at the depth of 1.0 μm from the surface is Hv=820 to 940.

3. A method of surface treating at titanium or titanium alloy comprising:

a heating process comprising steps of disposing a titanium or titanium alloy in a vacuum vessel, and applying annealing treatment thereto by heating to a range of 650 to 830° C. in a reduced pressure atmosphere;

a hardening treatment process comprising steps of feeding a mixed gas consisting primarily of nitrogen with 100 to 30,000 ppm of oxygen into the vacuum vessel, and heating inside the vacuum vessel at a temperature in the range of 700 to 800° C. in a reduced pressure atmosphere whose pressure is adjusted in a range of 0.01 to 10 Torr (1.33 to 1330 Pa) such that nitrogen and oxygen are diffused into the interior of the titanium or titanium alloy from the surface thereof so as to pass into solid solution therein; and a cooling process whereby the titanium or titanium alloy is cooled to room temperature after the hardening treatment process.

4. A method of surface treating a titanium or titanium alloy according to claim 3, wherein said heating process is applied in reduced pressure conditions after the vacuum vessel is evacuated to form a vacuum.

5. A method of surface treating a titanium or titanium alloy according to claim 3, wherein said heating process is applied in reduced pressure conditions where an inert gas is fed into the vacuum vessel after the vacuum vessel is evacuated to form a vacuum.

6. A method of surface treating a titanium or titanium alloy according to claim 3, wherein said cooling process is applied in a vacuum atmosphere in which the mixed gas consisting primarily of nitrogen is removed by evacuating the vacuum vessel to form a vacuum.

7. A method of surface treating a titanium or titanium alloy according to claim 3, wherein said cooling process is applied in reduced pressure conditions where an inert gas is fed into the vacuum vessel upon removing the mixed gas consisting primarily of nitrogen, by evacuating the vacuum vessel to form a vacuum.

8. A method of surface treating a titanium or titanium alloy according to claim 3, wherein said mixed gas consisting primarily of nitrogen gas containing a trace of oxygen gas.

9. A method of surface treating a titanium or titanium alloy according to claim 8, wherein said mixed gas consists primarily of nitrogen and contains a trace of hydrogen gas.

10. A method of surface treating a titanium or titanium alloy according to claim 3, wherein said mixed gas consists primarily of nitrogen gas containing a trace of water vapor.

11. A method of surface treating a titanium or titanium alloy according to claim 10, wherein said mixed gas consists primarily of nitrogen and contains a trace of carbon dioxide or carbon monoxide.

12. A method of surface treating a titanium or titanium alloy according to claim 3, wherein said mixed gas consists primarily of nitrogen gas containing a trace of alcohol gas.

13. A titanium or titanium alloy having a hard surface layer at a depth from a surface thereof, said hard surface layer being formed by:

a heating process comprising steps of disposing a titanium or titanium alloy in a vacuum vessel, and applying annealing treatment thereto by heating to a range of 650 to 830° C. in a reduced pressure atmosphere;

a hardening treatment process comprising steps of feeding a mixed gas consisting primarily of nitrogen with 100 to 30,000 ppm of oxygen into the vacuum vessel, and heating inside the vacuum vessel at a temperature in the range of 700 to 800° C. in an atmosphere whose pressure is adjusted in a range of 0.01 to 10 Torr (1.33 to 1330 Pa) such that nitrogen and oxygen are diffused into the interior of the titanium or titanium alloy from the surface thereof so as to pass into solid solution therein; and a cooling process whereby the titanium or titanium alloy is cooled to room temperature after the hardening treatment process.

14. A method of surface treating a titanium or titanium alloy according to claim 3, wherein treatment temperatures both in the heating process and in the hardening treatment process are in a range of 730 to 780° C.

* * * * *

UNITED STATES PATENT AND TRADEMARK OFFICE

CERTIFICATE OF CORRECTION

PATENT NO. : 6,221,173 B1
DATED : April 24, 2001
INVENTOR(S) : Shibuya, et al.

It is certified that error appears in the above-identified patent and that said Letters Patent is hereby corrected as shown below:

Column 22,
Line 29, between "of" and "nitrogen", insert -- nitrogen is --.
Line 32, change "8" to read -- 3 --.

Signed and Sealed this

Twenty-third Day of October, 2001

*Attest:*

Nicholas P. Godici

*Attesting Officer*

NICHOLAS P. GODICI
*Acting Director of the United States Patent and Trademark Office*